US007028344B2

(12) United States Patent
Toth

(10) Patent No.: US 7,028,344 B2
(45) Date of Patent: Apr. 18, 2006

(54) SYSTEMS AND METHODS FOR PROVIDING A HEADGEAR COOLING LINER

(76) Inventor: Gregory T. Toth, 1121 10th St., Rock Springs, WY (US) 82901-5422

( * ) Notice: Subject to any disclaimer, the term of this patent is extended or adjusted under 35 U.S.C. 154(b) by 38 days.

(21) Appl. No.: 10/809,878

(22) Filed: Mar. 25, 2004

(65) Prior Publication Data

US 2004/0226077 A1 Nov. 18, 2004

Related U.S. Application Data

(60) Provisional application No. 60/470,282, filed on May 14, 2003.

(51) Int. Cl.
*A42B 3/10* (2006.01)

(52) U.S. Cl. ..... 2/413; 2/171.2; 2/181; 2/7; 62/259.3; 165/46; 607/110

(58) Field of Classification Search ..... 2/414, 2/413, 171.2, 181, 181.4, 181.6, 181.8, 182.1, 2/7, 182.2, 182.3, 182.8; 165/46; 126/204; 62/259.3, 530; 607/109, 110, 114, 112
See application file for complete search history.

(56) References Cited

U.S. PATENT DOCUMENTS 4,397,045 A * 8/1983 Schonwetter et al. ..... 2/5
4,425,917 A * 1/1984 Kuznetz ..... 607/110
4,815,144 A * 3/1989 Martin ..... 2/7
4,854,319 A * 8/1989 Tobin ..... 607/109
4,908,248 A * 3/1990 Nakashima et al. ..... 428/35.5
5,058,210 A * 10/1991 Tivis ..... 2/181
5,517,691 A * 5/1996 Blake ..... 2/5
5,605,144 A * 2/1997 Simmons et al. ..... 126/204
5,630,230 A * 5/1997 Fujino et al. ..... 2/200.1
5,755,110 A * 5/1998 Silvas ..... 62/259.3
5,785,980 A * 7/1998 Mathewson ..... 424/402
5,950,234 A * 9/1999 Leong et al. ..... 2/7
6,178,562 B1 * 1/2001 Elkins ..... 2/458
6,269,654 B1 * 8/2001 Murray et al. ..... 62/530
6,698,510 B1 * 3/2004 Serra et al. ..... 165/185
6,792,624 B1 * 9/2004 Simmons ..... 2/209.13

(Continued)

OTHER PUBLICATIONS

OccuNomix www.occunomix.com.

(Continued)

*Primary Examiner*—Rodney M. Lindsey
(74) *Attorney, Agent, or Firm*—Dale E. Hulse; David B. Tingey; Kirton & McConkie

(57) ABSTRACT

Systems and methods for providing an article associated with headgear that keeps the wearer's head both cool and cushioned from the interior harness of the headgear. The article is a system, liner or pad that is inserted into the headgear or coupled to the headgear harness for cooling and comfort, and includes a water absorbent polymer or other material contained within non-impervious pocket partitions attached to a concave disk of mesh fabric. The mesh fabric provides ventilation portions, which allow for the free flow of air and breathing of the wearer's scalp to facilitate the natural evaporation of perspiration. The article provides a cushion to the wearer's scalp from the abrasive effect of the webbing of the headgear harness. As the pocket partitions swell due to absorption of water by the polymer material, the pockets function as gel-like cushions or pads that protect the wearer's scalp. The article is held in place with small straps, Velcro® tabs, or other retention devices.

19 Claims, 5 Drawing Sheets

U.S. PATENT DOCUMENTS

| | | | | |
|---|---|---|---|---|
| 6,817,039 | B1 * | 11/2004 | Grilliot et al. | 2/413 |
| 6,904,617 | B1 * | 6/2005 | Tsai | 2/209.13 |
| 2003/0200598 | A1 * | 10/2003 | Jessie | 2/413 |

OTHER PUBLICATIONS

Sparkling Earth www.sparklingearth.com.

* cited by examiner

SYSTEMS AND METHODS FOR PROVIDING A HEADGEAR COOLING LINER

RELATED APPLICATIONS

This application claims priority to U.S. Patent Application Ser. No. 60/470,282 filed May 14, 2003, entitled HEADGEAR COOLING LINER, which is incorporated herein by reference.

BACKGROUND OF THE INVENTION

1. Field of the Invention

The present invention relates to headgear. In particular, the present invention relates to systems and methods for providing a headgear cooling liner having one or more ventilation portions and one or more pocket partitions, wherein the pocket partitions include a liquid-absorbing material, and wherein the headgear cooling liner provides a cooling effect to the person wearing the headgear.

2. Background and Related Art

A variety of endeavors that are performed by individuals include the wearing of protective headgear. One such example is military duty, where a soldier typically wears a protective helmet for combat. When the combat takes place in warm climates, the wearing of the protective helmet assists in causing the soldier to become hot and exhausted in the hot weather.

Another example is present in the construction industry. Hard hats are typically worn by workers in construction zones to provide protection from potential dangers. When worn in warm temperatures, the hard hats helps cause the workers to become hot and exhausted in the warm weather.

Current techniques of combating heat and/or exhaustion caused by using protective headgear in hot climates include the consumption of cooled liquids and/or the utilization of helmet liners. The available liners form a complete and solid cap about the user's head, and have the appearance to warm the user rather than to cool the user. These liners create a damp and uncomfortable environment within the headgear and against the user's scalp and skin.

Thus while techniques currently exist that are used to combat the heat and/or exhaustion caused by using protective headgear, challenges still exist. Accordingly, it would be an improvement in the art to augment or even replace current techniques with other techniques.

SUMMARY OF THE INVENTION

The present invention relates to headgear. In particular, the present invention relates to systems and methods for providing a headgear cooling liner having one or more ventilation portions and one or more pocket partitions, wherein the pocket partitions include a liquid-absorbing material, and wherein the headgear cooling liner provides a cooling effect and a cushion to the person wearing the headgear.

Implementation of the present invention takes place in association with an article associated with headgear that keeps the wearer's head both cool and cushioned from the interior harness of the headgear. In at least some implementations, the article is a system, liner or pad that is inserted into the headgear or coupled to the headgear harness for cooling and comfort. The article includes a water absorbent polymer or other material contained within the non-impervious pocket partitions attached to a concave disk of mesh fabric. The mesh fabric provides ventilation portions, which allow for the free flow of air and breathing of the wearer's scalp to facilitate the natural evaporation of perspiration.

In at least some implementations, the article provides a cushion to the wearer's scalp from the abrasive effect of the webbing of the headgear harness. As the pocket partitions swell due to absorption of water by the polymer material, the pockets function as gel-like cushions or pads that protect the wearer's scalp. The article is held in place with small straps, Velcro® tabs, or other retention devices.

While the methods and processes of the present invention have proven to be particularly useful in the area of military helmets, those skilled in the art can appreciate that the methods and processes can be used in a variety of different applications and in a variety of different headgear systems to provide a cooling device to the user of the headgear. Examples of such applicable headgear include military helmets, construction hats, sporting or other recreational helmets, and other headgear where a cooling and/or cushioning effect is desirable.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The present invention relates to headgear. In particular, the present invention relates to systems and methods for providing a headgear cooling liner having one or more ventilation portions and one or more pocket partitions, wherein the pocket partitions include a liquid-absorbing material, and wherein the headgear cooling liner provides a cushioning and/or cooling effect to the person wearing the headgear.

In the disclosure and in the claims the term "headgear" shall refer to any kind of covering or protective device for the head. Examples of headgear include a helmet (e.g., military helmet, recreational helmet, sporting helmet, etc.), a hat (e.g., recreational hat, construction hard hat, etc.), a headdress, a hood, or any other head covering for which cooling and/or cushioning is desired.

Embodiments of the present invention embrace an article associated with headgear that keeps the wearer's head cool and/or cushioned from an interior harness of the headgear. In at least some embodiments, the article is a system, liner or pad that is inserted into the headgear or coupled to the headgear harness or interior surface for cooling and/or comfort. The article includes a water absorbent polymer or other material contained within the non-impervious pocket partitions attached to a concave webbing lattice or disk of mesh fabric. The mesh fabric provides ventilation portions, which allow for the free flow of air and breathing of the wearer's scalp to facilitate the natural evaporation of perspiration.

In at least some embodiments, the article provides a cushion to the wearer's scalp from the abrasive effect of the webbing of the headgear harness. As the pocket partitions swell due to absorption of water by the polymer material, the pockets function as gel-like cushions or pads that protect the wearer's scalp. The article is held in place with straps, Velcro® tabs, or other retention devices.

Figure 1:
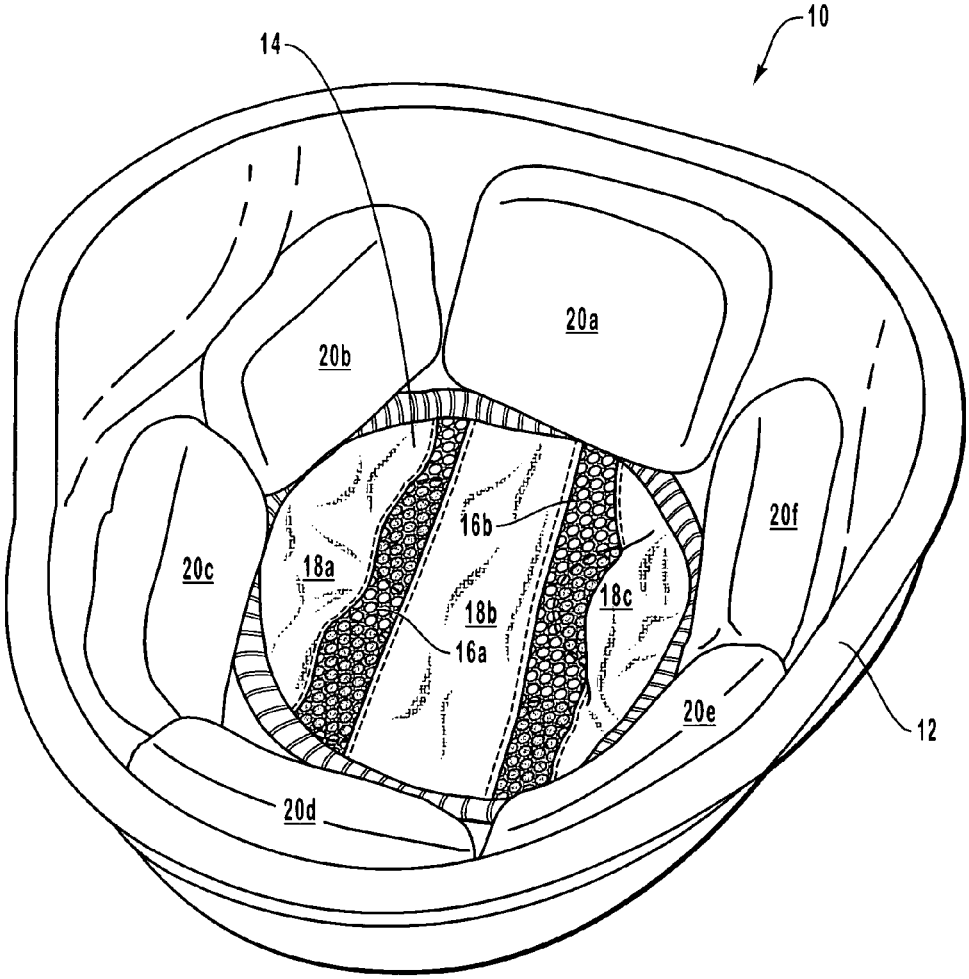
FIG. 1 illustrates a perspective view of a representative embodiment in accordance with the present invention.

With reference now to FIG. 1, a general description is provided of a representative embodiment in accordance with the present invention. In FIG. 1, cooling system 10 includes headgear 12 and headgear cooling liner 14, which comprises one or more ventilation portions 16 and one or more pocket partitions 18. In the present embodiment, headgear 12 is a military helmet and includes a plurality of cushions 20 that form a fitting system at the interior of headgear 12. While the fitting system of headgear 12 includes a plurality of pads 20, those skilled in the art will appreciate that the embodiments of the present invention include any type of fitting or harness system used in association with wearing headgear. Examples include straps, pads, cushions, etc.

In the present embodiment, headgear cooling liner 14 is designed of a specific size (e.g., approximately six inches in diameter) so that liner 14 fits within a military helmet. Pads 20 are provided so as to not compromise the protection provided by headgear 12. In at least some embodiments, the headgear cooling liner is also of the correct size to fit in other headgear, such as hard hats and helmets that could be used in work or sports.

Figure 2:
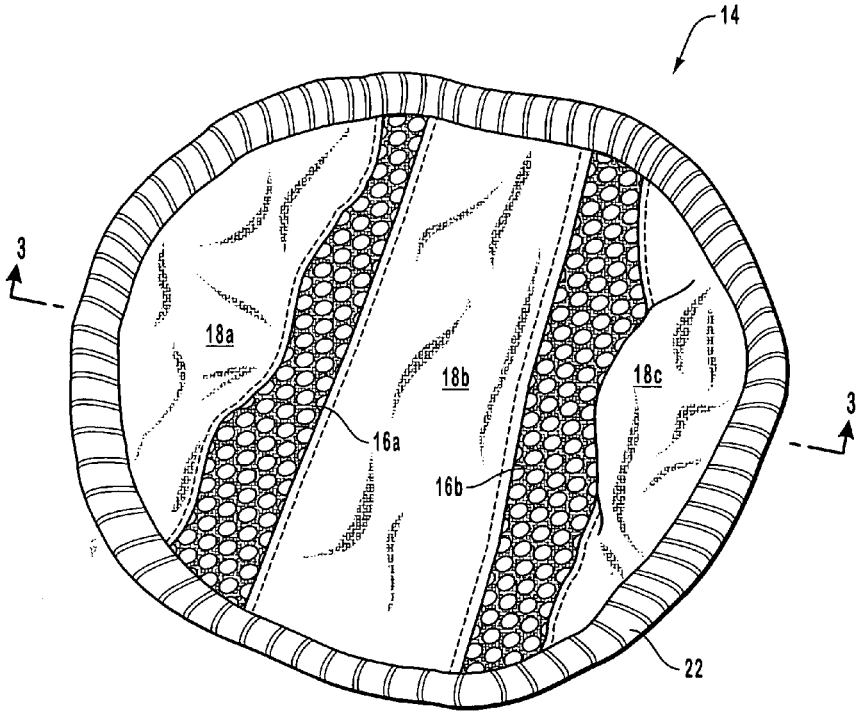
FIG. 2 illustrates a perspective view of the headgear cooling liner of FIG. 1.
Figure 3:
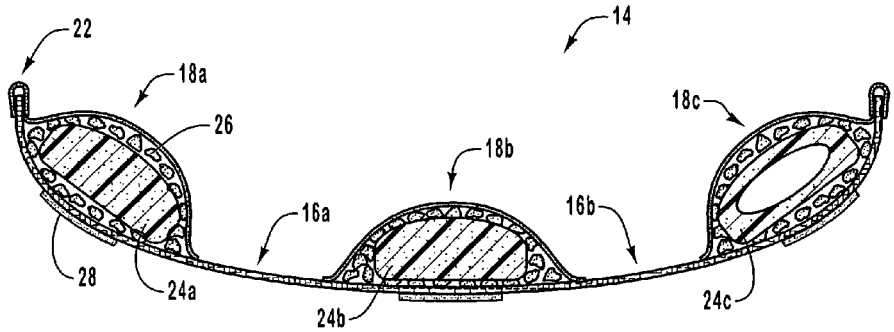
FIG. 3 illustrates a cross sectional view of the headgear cooling liner of FIG. 1.

Headgear cooling liner 14 is more specifically illustrated in FIGS. 2–3. In accordance with embodiments of the present invention, a headgear cooling liner includes means to cool the scalp and means to cushion the scalp of the individual wearing headgear. As illustrated in FIG. 2, headgear cooling liner 14 includes one or more pocket partitions 18, which are attached to a mesh concave disk to provide one or more ventilation portions 16. As will be further discussed below, pocket partitions 18 contain a material that absorbs a liquid such as water to provide a cooling effect on the head of the wearer. Liner 14 further includes a hem or rim 22.

In the present embodiment, the elongated pocket partitions 18 are arranged with the longer axis from the front to the back and a distance from one another such that an air space (ventilation portion 16) is created between the pocket partitions 18. This allows for flow of air between the pocket partitions that facilitates the evaporation process. The liner is held in place by an attachment mechanism, as will be further discussed below.

With reference now to FIG. 3, a cross sectional view of the headgear cooling liner of FIGS. 1–2 is illustrated. As shown in FIG. 3, each pocket partition 18 contains a cushioning device 24 and a liquid-absorbing material 26. Headgear cooling liner 14 provides a cooling effect on the head of the individual wearing the headgear by having the chambers or pocket partitions 18 at least partly filled with the liquid-absorbing material 26. In at least some embodiments, the liquid absorbing material is a polymer, which absorbs water, expands and fills the chambers or pocket partitions 18 that are attached to the mesh cap. The cooling effect is facilitated by non-impervious properties of a layer of fabric used in construction that permit evaporation. Ventilation portion 16 comprises a mesh fabric that allows airflow.

Embodiments of the present invention embrace the utilization of solid and/or hollow cushioning devices. Thus, in one embodiment a cushioning device 24 is a solid material as illustrated by cushioning devices 24*a* and 24*b*. In another embodiment, a cushioning device is a hollow device as illustrated by cushioning device 24*c*. In at least some embodiments, each cushioning device is an elongated rubber material that extends down each pocket partition to provide cushioning to the individual. In the illustrated embodiment, cushioning devices 24 comprise poplin tubes containing polyacrilamide.

The liquid absorbing material 26 surrounds each cushioning device 24. When water or another liquid is absorbed by material 26, a gel-like substance is formed in pocket partitions 18 around devices 24. In at least some embodiments, the liquid-absorbing material is a polymer. In the illustrated embodiment, the liquid-absorbing material 26 comprises polyacrylamide beads that absorb a liquid such as water to form a gel, which may be used at ambient temperatures or may be selectively chilled or frozen to provide a cooling effect on the head of the wearer. As provided above, the cooling effect is facilitated by non-impervious properties of a layer of fabric that permit evaporation.

The illustrated beads of polyacrylamide are commercially known as anionic polyacrylamide powder and have a chemical name of copolymer of potassium acrylamide and potassium acrylate. The beads are commercially available, for example, from JRM Chemical, 15663 NEO Parkway, Cleveland, Ohio 44128. The beads of polyacrylamide are non-hazardous, and are a white granular solid. In the illustrated embodiment, the beads are sized 1 mm to 2 mm and are insoluble in water, but swell in water to a gel consistency that is many times the dry weight size. While the illustrated embodiment include beads that are 1 mm to 2 mm in size, embodiments of the present invention embrace the utilization of beads that are less than or greater than the 1–2 mm sized bead.

A variety of methods may be employed to place the polyacrylamide beads into the elongated tubular structures or pocket partitions made of poplin fabric, which retains the particles in either a wet or dry state but the small air gaps in the poplin allow for the transfer of airborne water molecules which causes the evaporation process to take place and thus the cooling effect enjoyed by the wearer. This poplin can be commercially purchased, for example, from E.E. Schenk Co., 4561 Maywood Ave., Vernon, Calif. 90058. While the present embodiment comprises poplin, but testing has shown that many other fabrics may be used that allow for the passage of water vapor but retain liquid-absorbing material.

In one method, the polyacrylamide beads are blown into the tubular structures or pocket partitions by a pneumatic-electric device that has been invented by the applicant for this purpose. This polymer injector, which is referred to as a "puffer," can be purchased from Greg Toth, 1121 10th St., Rock Springs, Wyo. 82901.

In other methods, the polyacrylamide beads are inserted into the tubular structures or pocket partitions through the utilization of a funnel, measuring spoon and/or another manner or device. Once the polyacrylamide beads have been injected, the pocket partitions are then sewn onto the mesh fabric that provides the primary structure and shape of the device. This mesh fabric can be commercially purchased, for example, from Apex Mills Corp., 168 Doughty Boulevard, Inwood, N.Y. 11096-0670. The mesh fabric allows for the free flow of air both across the pocket partitions and across the scalp of the wearer. In the illustrated embodiment, this mesh material includes apertures having a diameter of approximately 4 mm. Those skilled in the art will appreciate that embodiments of the present invention embrace apertures that are larger or smaller than provided in the illustrated embodiment.

The mesh is then hemmed around its perimeter to provide rim 22. After the hemming process is accomplished, Velcro® attachment straps or tabs 28 are then sewn on or otherwise coupled to the headgear cooling liner.

While FIGS. 1–3 illustrate a headgear cooling liner having the elongated pocket partitions arranged with the longer axis from the front to the back and a distance from one another, other embodiments of the present invention embrace other headgear cooling liners that still provide the air space through a ventilation portion between pocket partitions to allow for air flow between the pocket partitions. For example, with reference now to FIG. 4, another embodiment of a headgear cooling liner in accordance with the present invention is illustrated as headgear cooling liner 30.

Figure 4:
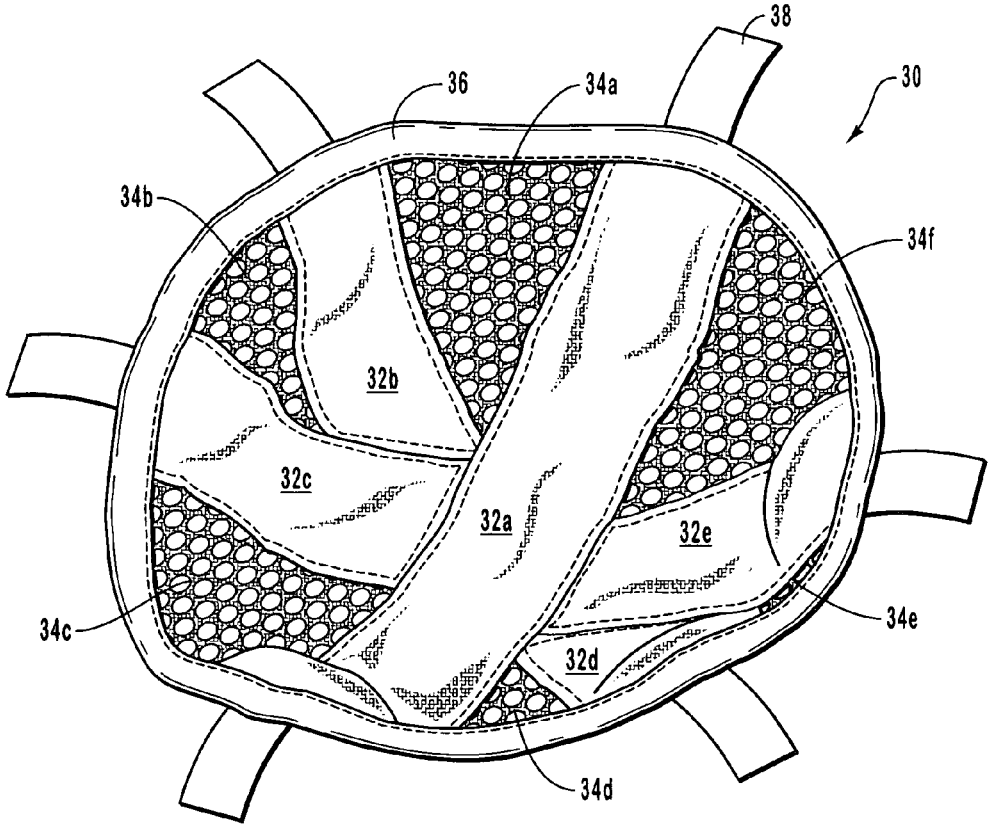
FIG. 4 illustrates a perspective view of another representative headgear cooling liner in accordance with another embodiment of the present invention.

In FIG. 4 headgear cooling liner 30 comprises one or more pocket partitions 32, one or more ventilation portions 34, a rim 36, and attachment tabs 38. Each pocket partition 32 comprises a cushion device (not shown) and a liquid-absorbing material (not shown). In the present embodiment attachment straps 38 are Velcro® strips that are configured to wrap around or otherwise couple liner 30 to an interior structure of a headgear. In the illustrated embodiment, the Velcro® strips are ½ inch wide and 5 inches long, however those skilled in the art will appreciate that other embodiments embrace utilization of smaller or larger strips. In the present embodiment, one end is sewn to liner 30 and the other is left free to be inserted around the harness in the headgear.

Headgear cooling liner 30 allows for the flow of cooling air between the tubular structures or pocket partitions. The headgear cooling liner 30 includes elongated chambers separated by mesh fabric that allows for airflow and enhances the cooling effect. The use of a breathable mesh material to provide the form of headgear cooling liner 30 with large separate cooling tubular structures or pocket partitions provides enhanced results. In one embodiment, materials used to provide a headgear cooling liner comprised flame resistant material.

Figure 5:
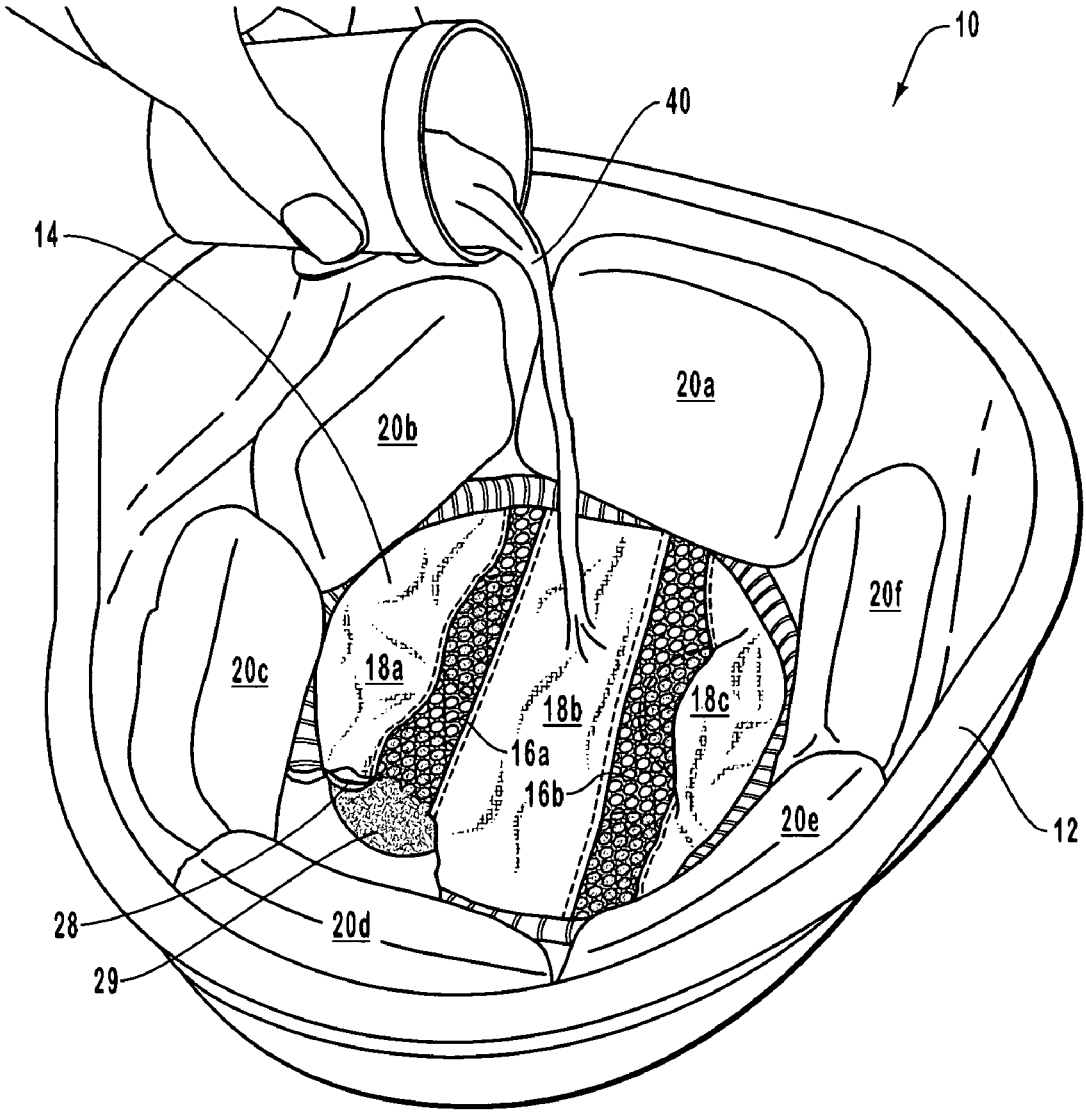
FIG. 5 illustrates a representative embodiment for providing a liquid to a representative headgear cooling liner for absorption.

With reference now to FIG. 5, a representative embodiment is illustrated that includes applying a liquid to a headgear cooling liner. In according with embodiments of the present invention, a liquid may be applied in a variety of manners. For example, a headgear cooling liner may be sprayed, soaked or other wise provided with water or another liquid to replenish the cooling effect as often as is necessary. In some embodiments, the liquid includes the natural perspiration of the user. In the illustrated embodiment, headgear 12 is turned upside down like a bowl and filled with cold water. After a period of approximately 20 minutes, the pocket partitions are inflated and ready to provide the wearer with several hours of cooling comfort.

In FIG. 5, a liquid 40 is applied to headgear cooling liner 14 to allow liquid 40 to be absorbed by a liquid absorbing material contained in pocket partitions 18 to create a gel-like substance. Through the natural process of evaporation, liner 14 cools the scalp of the wearer, providing a degree of cooling comfort. In addition to the cooling effect provided, the soft pliable chambers or pocket partitions protect the wearer from irritation and chaffing caused by the harness and/or hatband of the headgear.

In accordance with embodiments of the present invention, a headgear cooling liner may be coupled to an interior surface or structure of a headgear in a variety of manners. FIG. 5 illustrates a cutaway portion to demonstrate how a Velcro® tab 28 on the exterior surface of headgear cooling liner 14 is selectively coupled to a Velcro® tab 29 on the interior surface or structure of headgear 12. In the present embodiment, the entire liner 14 is held in place by Velcro® tabs 28, which are coupled to the exterior surface of the liner, and are configured to receive Velcro® tabs 29 of the interior surface of headgear 12 to couple the headgear cooling liner 14 to the headgear 12. While the illustrated embodiment includes Velcro® tabs as a coupling mechanism, other embodiments embrace other coupling mechanisms, including an adhesive, straps, snaps, etc. to couple liner 14 to headgear 12.

While headgear 12 is a military helmet, those skilled in the art will appreciate that embodiments in the present invention embrace any type of headgear, including industrial safety hard hat, supporting safety head gear, etc. Thus, by way of example, FIG. 6 illustrates a perspective view of another representative embodiment in accordance with the present invention.

Figure 6:
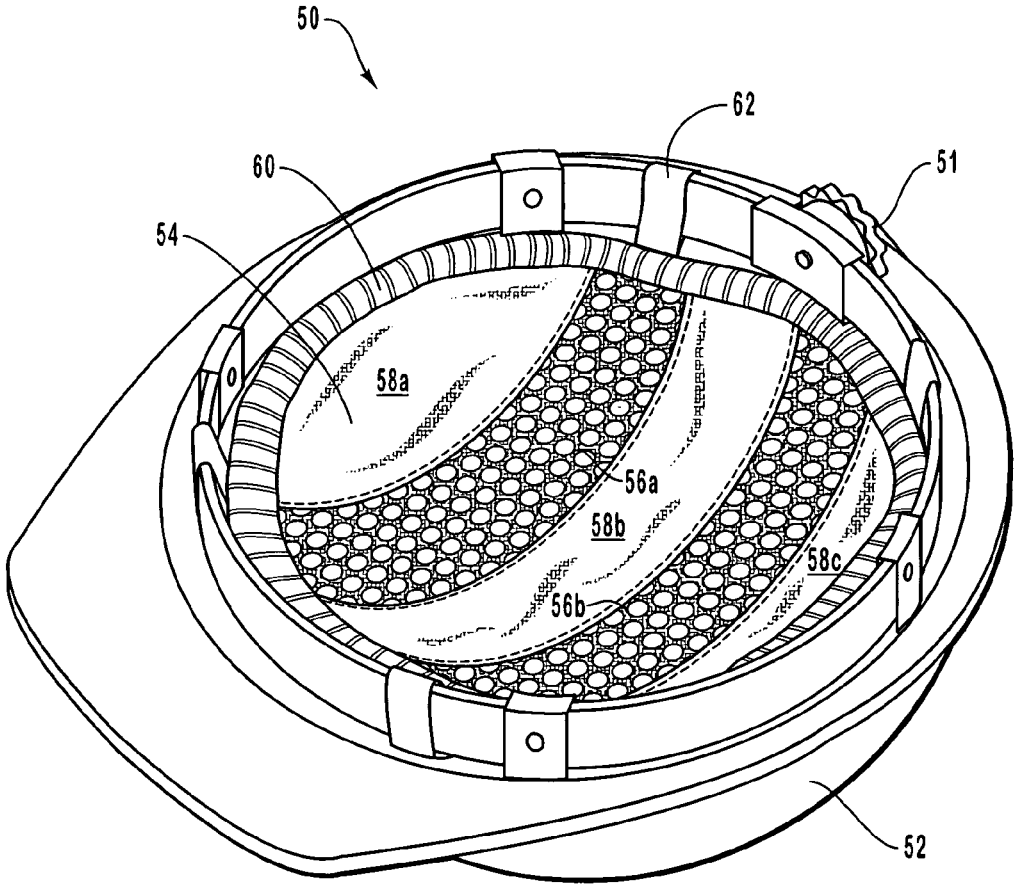
FIG. 6 illustrates a perspective view of another representative embodiment in accordance with the present invention.

In FIG. 6 a representative embodiment illustrates headgear 50, which is a construction hard had that includes an exterior surface 52 and a selectively adjustable interior harness system 51. A headgear cooling liner 54 is selectively coupled to headgear 50. In the present embodiment, headgear cooling liner 54 is coupled to system 51 and includes one or more ventilation portions 56, one or more pocket partitions 58 containing a liquid absorbing material, and rim 60. In a further embodiment, the pocket partitions further include a cushioning device. Headgear cooling liner 54 further includes tabs 62, which are configured to selectively couple liner 54 to system 51.

Thus, embodiments of the present invention relates to an article of headgear that, when installed into a protective helmet, hard hat or other headgear, keeps the wearer's head both cool and cushioned from the interior harness of said headgear. More particularly, a protective pad is provided for inclusion into a helmet or protective headgear for cooling and comfort. The article, pad or liner includes a water absorbent polymer or other material as a coolant through evaporation, allowed by the polymer being contained within non-impervious pockets attached to the concave disk of mesh fabric. The mesh fabric used for attachment of the pockets allows for the free flow of air, which allows for the evaporative process to occur, but also allows for the breathing of the scalp to facilitate the natural evaporation of sweat. The article, pad or liner further provides a cushion to the scalp of the wearer from the abrasive effect of the webbing in the helmet harness. As the pockets swell with water due to absorption, the pockets become cushions or pads that protect the scalp. The article, pad, liner or device is held in place with one or more retention mechanisms.

As is provided herein, in one embodiment the headgear cooling liner covers only a portion of the headgear interior, while in another embodiment the liner covers the entire interior of the headgear to provide a cooling effect on the head of a person wearing the headgear.

Thus, as discussed herein, the embodiments of the present invention embrace headgear. In particular, the present invention relates to systems and methods for providing a headgear cooling liner having one or more ventilation portions and one or more pocket partitions, wherein the pocket partitions include a liquid-absorbing material, and wherein the headgear cooling liner provides a cooling effect to the person wearing the headgear.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A headgear cooling liner comprising:

a liquid permeable pocket partition containing a liquid-absorbing material, the pocket partition including a cushioning device; and a ventilation portion adjacent to the pocket partition that establishes an air space to provide air ventilation.

2. A headgear cooling liner as recited in claim 1, wherein the air ventilation enables an evaporation process to occur.

3. A headgear cooling liner as recited in claim 1, wherein the material is a polymer.

4. A headgear cooling liner as recited in claim 3, wherein the polymer is polyacrylamide.

5. A headgear cooling liner as recited in claim 1, wherein the cushioning device comprises a rubber material.

6. A headgear cooling liner as recited in claim 1, further comprising a second liquid permeable pocket partition containing the liquid-absorbing material, wherein the pocket partitions are oriented in a parallel orientation, and wherein the ventilation portion couples and separates the pocket partitions.

7. A headgear cooling liner comprising:

a liquid permeable pocket partition containing a liquid-absorbing material, the pocket partition including a cushioning device;

a ventilation portion adjacent to the pocket partition that establishes an air space to provide air ventilation; and a second liquid permeable pocket partition containing the liquid-absorbing material, wherein the pocket partitions are oriented in a transverse orientation, and wherein the ventilation portion couples and separates at least some corresponding portions of the pocket partitions.

8. A headgear cooling liner comprising:

a liquid permeable pocket partition containing a liquid-absorbing material;

a ventilation portion adjacent to the pocket partition that establishes an air space to provide air ventilation; and an attachment mechanism configured to couple the headgear cooling liner to an interior portion of a headgear, wherein the coupling mechanism is coupled to at least one of:

(i) the pocket partition;

(ii) the ventilation portion; and (iii) a rim coupled to at least one of the pocket partition and the ventilation portion.

9. A cooling system comprising:

a headgear having an interior portion and an exterior portion;

a headgear liner selectively coupled to the interior portion of the headgear, wherein the headgear liner comprises:

a liquid permeable pocket partition containing a liquid-absorbing material; and a ventilation portion adjacent to the pocket partition that establishes an air space to provide air ventilation.

10. A cooling system as recited in claim 9, wherein the air ventilation enables at least a portion of the liquid absorbed by the material to evaporate.

11. A cooling system as recited in claim 9, wherein the interior portion is an interior surface of the headgear.

12. A cooling system as recited in claim 9, wherein the interior portion is a harness coupled to the headgear.

13. A cooling system as recited in claim 9, wherein the liquid-absorbed material is a polymer.

14. A cooling system as recited in claim 13, wherein the polymer is polyacrylamide.

15. A cooling system as recited in claim 9, wherein the pocket partition further includes a cushioning device.

16. A cooling system as recited in claim 9, wherein the headgear is one of:

(i) a military helmet;

(ii) a construction hard hat; and (iii) a recreational helmet.

17. A method for providing a headgear cooling system, the method comprising:

providing a headgear liner having a liquid permeable pocket partition and a ventilation portion;

inserting a liquid-absorbing material into the pocket partition, wherein when a liquid is applied to the pocket partition, at least a portion of the liquid is absorbed into the material; and securing a coupling mechanism onto a portion of the headgear liner for use in coupling the headgear liner to a headgear for use by an individual, wherein when coupled to the headgear, at least a portion of the headgear liner establishes an air space to provide air ventilation when the headgear is used by the individual.

18. A method as recited in claim 17, further comprising using the coupling mechanism to secure the headgear liner to the headgear.

19. A method as recited in claim 18, further comprising at least one of:

(i) cooling the liquid after the liquid is applied to the pocket partition and absorbed by the material, and prior to use of the headgear by the individual; and (ii) freezing the liquid after the liquid is applied to the pocket partition and absorbed by the material, and prior to use of the headgear by the individual.

* * * * *